US008787791B2

(12) United States Patent
Watanabe

(10) Patent No.: US 8,787,791 B2
(45) Date of Patent: Jul. 22, 2014

(54) PACKAGING ARRANGEMENT FOR IMAGE FORMATION APPARATUS ACCOMMODATING PROCESS CARTRIDGE

(75) Inventor: Yasunori Watanabe, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 141 days.

(21) Appl. No.: 13/352,382

(22) Filed: Jan. 18, 2012

(65) Prior Publication Data

US 2012/0183326 A1 Jul. 19, 2012

(30) Foreign Application Priority Data

Jan. 18, 2011 (JP) ..... 2011-007623

(51) Int. Cl.
*G03G 21/16* (2006.01)

(52) U.S. Cl.
USPC ..... 399/110; 399/97; 399/111

(58) Field of Classification Search
CPC G03G 21/181; G03G 21/1604; G03G 21/203
USPC ..... 399/110, 111, 97, 411, 114
See application file for complete search history.

(56) References Cited

U.S. PATENT DOCUMENTS

| | | | | |
|---|---|---|---|---|
| 5,481,343 | A * | 1/1996 | Bhagat | 399/274 |
| 6,654,573 | B2 * | 11/2003 | Carlson et al. | 399/92 |
| 6,823,151 | B2 * | 11/2004 | Carlson et al. | 399/92 |
| 7,463,844 | B2 | 12/2008 | Hashimoto et al. | |
| 7,922,973 | B2 * | 4/2011 | Yamakawa | 422/409 |
| 2007/0071495 | A1 | 3/2007 | Hashimoto et al. | |
| 2008/0068140 | A1 | 3/2008 | Taki et al. | |
| 2009/0311140 | A1 * | 12/2009 | Yamakawa | 422/55 |

FOREIGN PATENT DOCUMENTS

| | | | |
|---|---|---|---|
| JP | S62-78071 | A | 4/1987 |
| JP | S62-084981 | U | 5/1987 |
| JP | 07-104637 | | 4/1995 |
| JP | 08-104364 | A | 4/1996 |
| JP | H11218983 | A | 8/1999 |
| JP | 2005091708 | A | 4/2005 |
| JP | 2006-171407 | A | 6/2006 |
| JP | 2006-259448 | | 9/2006 |

(Continued)

OTHER PUBLICATIONS

Machine translation of Niimura, JP2006-171407. Jun. 29, 2006.*
Machine translation of Komatsu, JP2007-186249. Jul. 26, 2007.*
JP Office Action dtd Jan. 22, 2013, JP Appln. 2011-007623, English translation.

(Continued)

*Primary Examiner* — David Gray
*Assistant Examiner* — Carla Therrien
(74) *Attorney, Agent, or Firm* — Banner & Witcoff, Ltd.

(57) ABSTRACT

A packaging arrangement of an image formation apparatus and a process cartridge includes a main body formed with an accommodation chamber configured to accommodate a process cartridge containing toner used for image formation. The main body is formed with an opening through which the process cartridge is detachably attached. The image formation apparatus is configured to be packaged with the process cartridge attached in the accommodation chamber. An openable cover configured to openably cover the opening is provided, and a drying agent is detachably arranged in a clearance formed between an inner face of the accommodation chamber and the process cartridge attached in the accommodation chamber. A part of the drying agent is exposed to outside through the opening of the clearance when the cover is opened, while the process cartridge and the drying agent are covered when the cover is closed.

12 Claims, 8 Drawing Sheets

(56) References Cited

FOREIGN PATENT DOCUMENTS

| | | | |
|---|---|---|---|
| JP | 2007-186249 | A | 7/2007 |
| JP | 2007-216999 | | 8/2007 |
| JP | 2008073886 | A | 4/2008 |
| JP | 2010-054828 | A | 3/2010 |

OTHER PUBLICATIONS

Japanese Office Action dated Jan. 22, 2013 in Japanese Patent Application No. 2011-007624.

Japanese Office Action dated Aug. 20, 2013 in Japanese Patent Application No. 2011-007623.

Japanese Office Action dated Aug. 20, 2013 in Japanese Patent Application No. 2011-007624.

* cited by examiner

PACKAGING ARRANGEMENT FOR IMAGE FORMATION APPARATUS ACCOMMODATING PROCESS CARTRIDGE

CROSS-REFERENCE TO RELATED APPLICATION

This application claims priority under 35 U.S.C. §119 from Japanese Patent Application No. 2011-007623 filed on Jan. 18, 2011. The entire subject matter of the application is incorporated herein by reference.

BACKGROUND

1. Technical Field

Aspects of the invention relate to a packaging arrangement for an image formation apparatus, and specifically, to an arrangement for the image formation apparatus accommodating a process cartridge when packaged for shipping.

2. Related Art

Generally, it is known that toner contained in a process cartridge for an image formation apparatus is deteriorated by moisture absorption, which may lower quality of formed images. Therefore, typically, the process cartridge is packaged in an airtight bag or the like so that the toner therein remains in a dried condition, and is packaged separately from the main body of the image formation apparatus.

SUMMARY

For distributing the main body of the image formation apparatus and a process cartridge therefor, in view of shedding materials for packaging and efficiency for shipping, it is suggested that the image formation apparatus is packaged with the process cartridge being mounted therein so that they can be packaged in a single box. When the image formation apparatus is packaged with the process cartridge being mounted therein, it is necessary that a charging roller and a developing roller are spaced from a photoconductive drum so as to prevent the photoconductive drum from being damaged as it is in contact with and/or in friction with the charging roller and/or developing roller by vibratory motion occurred during transportation.

When the image formation apparatus is packaged with the process cartridge being mounted therein, it is impossible to package the process cartridge in an airtight bag. Therefore, it is difficult to maintain the toner in the dried condition.

Aspects of the invention provide a packaging arrangement for an image formation apparatus which can suppress moisture absorption of the toner contained in the process cartridge.

According to aspects of the invention, there is provided a packaging arrangement of an image formation apparatus and a process cartridge, which includes a main body of the image formation apparatus formed with an accommodation chamber configured to accommodate a process cartridge containing toner used for image formation, the main body being formed with an opening through which the process cartridge is detachably attached to the main body, the image formation apparatus being configured to be packaged with the process cartridge attached in the accommodation chamber, an openable cover configured to openably cover the opening, and a drying agent arrange detachably arranged in a clearance which is formed between an inner face of the accommodation chamber and the process cartridge attached in the accommodation chamber. In this configuration, a part of the drying agent is exposed to outside through the opening of the clearance when the cover is in an opened state, and the cover is configured to cover the process cartridge and the drying agent when the cover is in a closed state.

BRIEF DESCRIPTION OF THE ACCOMPANYING DRAWINGS

DETAILED DESCRIPTION

A packaging arrangement of an image formation apparatus according to embodiments of the invention will be described with reference to the accompanying drawings.

Figure 1:
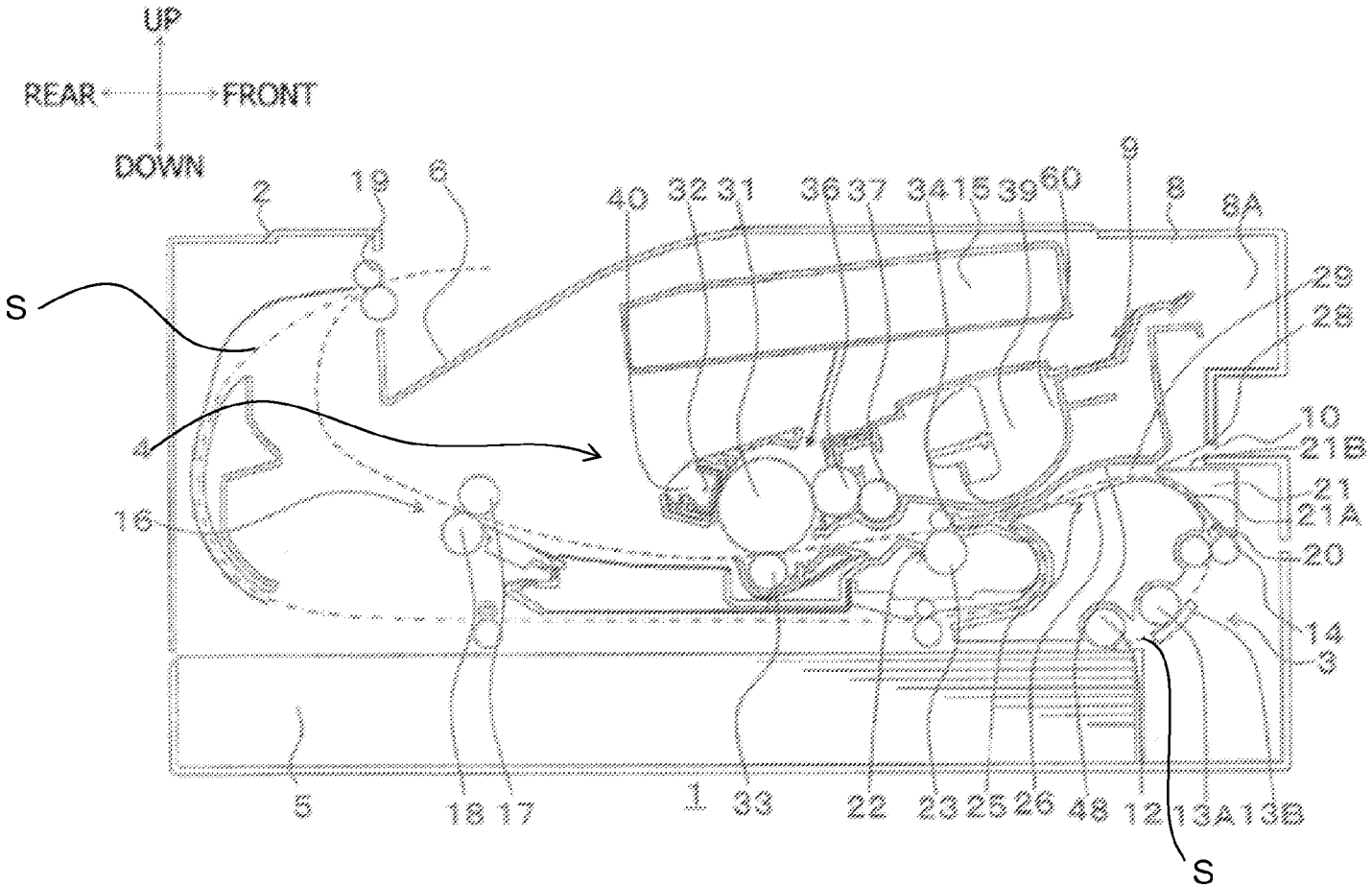
FIG. 1 is a cross-sectional side view of an image formation apparatus according to an embodiment of the invention.

As shown in FIG. 1, the image formation apparatus 1 has a housing 2. Inside the housing 2, provided are a sheet feed unit 3 from which sheets S are to be fed, an image formation unit 4 configured to form an image on each sheet S, a sheet tray 5 configured to contain the sheets S on which images have not yet been formed, and a discharge tray 6 configured to receive image-formed and discharged sheets S.

For the purpose of indicating directions in the following description, directions are defined as indicated in FIG. 1. The directions are basically defined in view of a user who uses the image formation apparatus 1. Specifically, a front cover 8 side is defined as a front side, and an opposite direction is defined as a rear side. A direction from the front side to the rear side is occasionally referred to as a depth direction. An up and down directions in FIG. 1 are defined as top and bottom directions, respectively. Further, although not shown in FIG. 1, a left side and a right side of the image formation apparatus are defined as a near side and far side with respect to a plane of FIG. 1, respectively.

Figure 2:
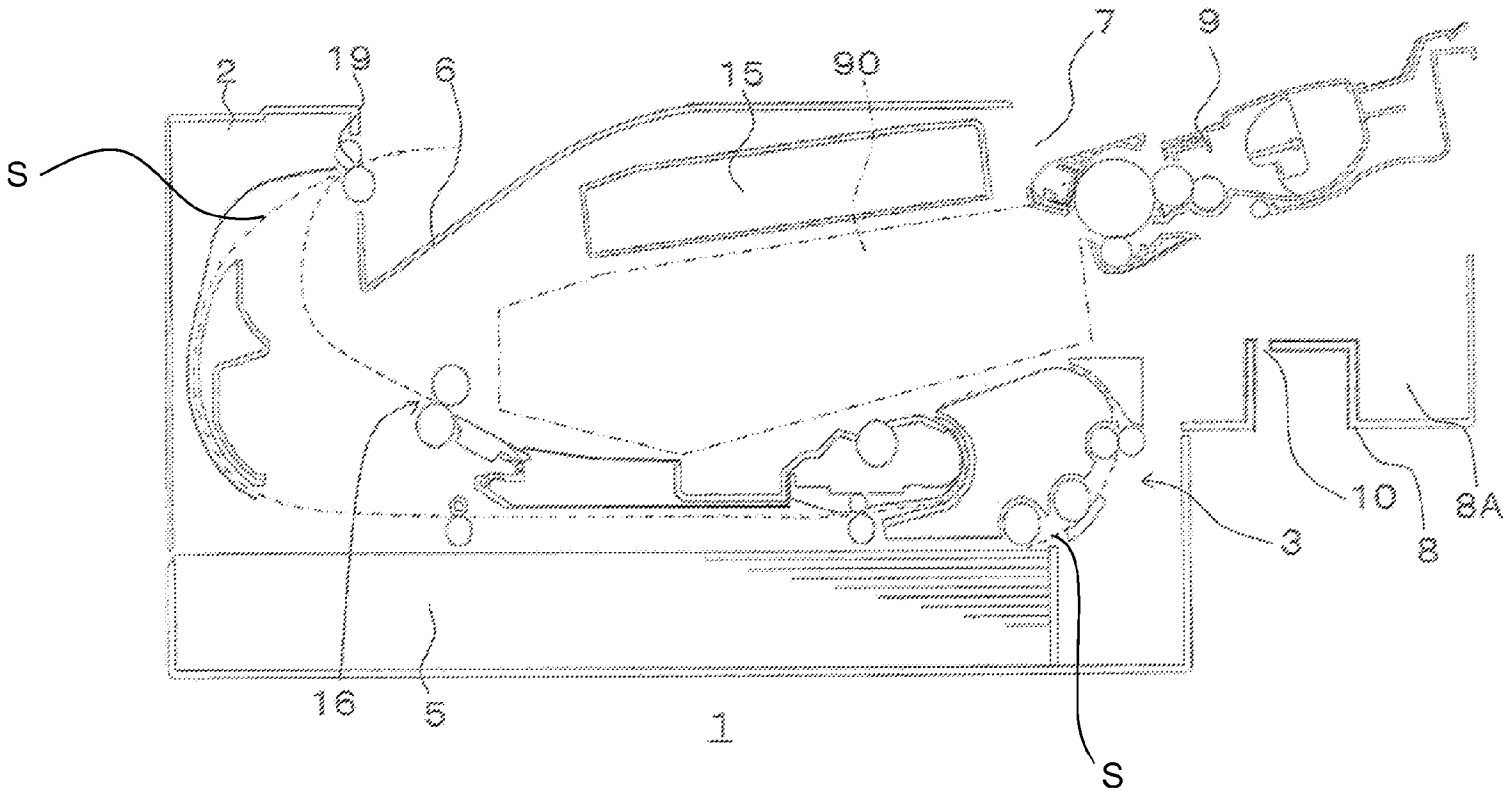
FIG. 2 is a cross-sectional side view of the image formation apparatus when a process cartridge is inserted in or removed from the image formation apparatus according to the embodiment of the invention.

As shown in FIG. 2, an opening 7 is formed on the housing 2. Through the opening 7, the process cartridge 9 can be inserted in and/or removed from the image formation apparatus 1. Further, an openable/closeable front cover 8 configured to completely expose and/or cover the opening 7 is rotatably supported onto the housing 2. On the front cover 8, a manual feed opening 10 is formed to penetrate in the front-and-rear direction. Through the manual feed opening 10, a sheet S can be fed toward the image formation unit 4 (see FIG. 1). It is noted that, according to another configuration, the manual feed opening 10 may be formed on a front face of the housing 2 instead of the front cover 8. Further to the above, the front cover 8 is formed with a concave portion 8A, which is formed to extend on inner side of the image formation apparatus 1, at a portion between an upper face of the front cover 8 and the manual feed opening 10. The concave portion 8A extends in the right-and-left direction (i.e., a direction perpendicular to the plane of FIG. 1).

Figure 7:
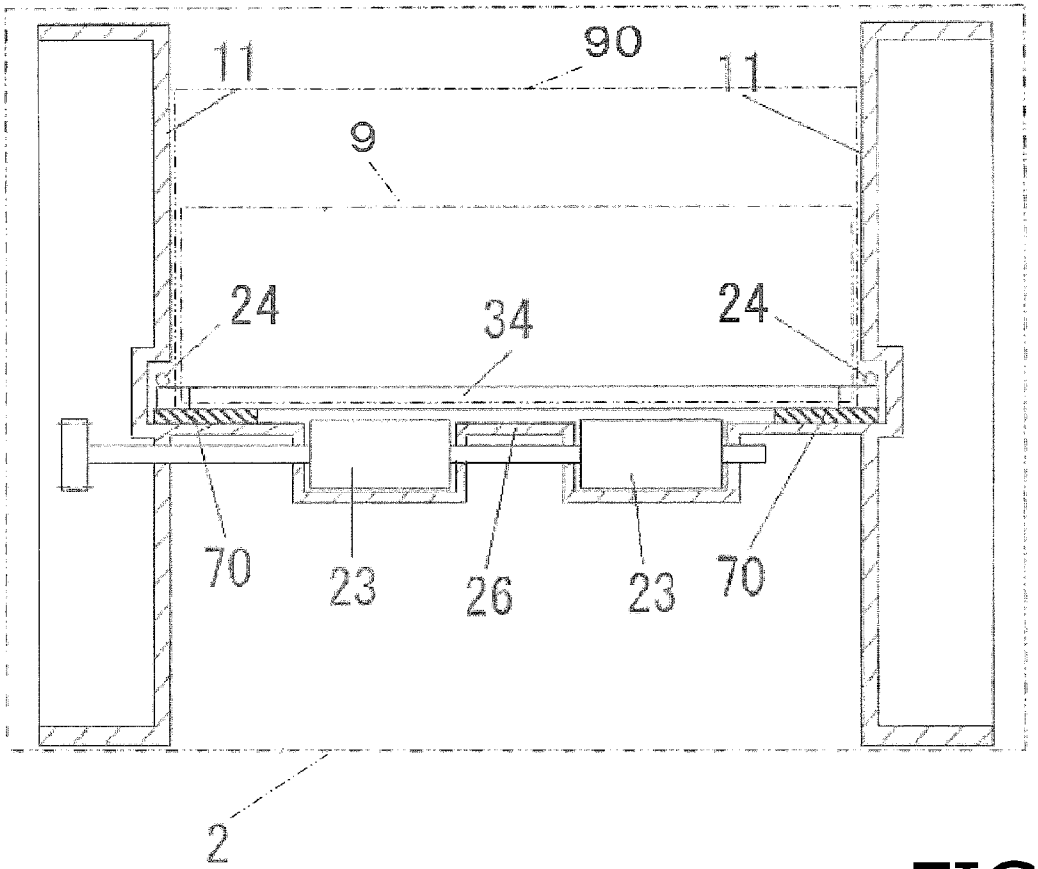
FIG. 7 is a cross-sectional front view of the image formation apparatus viewed from the front side thereof, according to the first embodiment of the invention.

Main components such as the image formation unit 4 and the process cartridge 9 are supported by a pair of frames 11 which are arranged on right and left sides of the image formation apparatus 1, and extends in the front-and-rear direction, as shown in FIG. 7. In the following description, the housing 2 including components therein (e.g., the pair of frames 11, the sheet feed unit 3, an exposure unit 14, and a fixing unit 16) except for the process cartridge 9 will occasionally be referred to as a "main body" of the image formation apparatus 1. Inside the main body, between the pair of frames 11, and between the exposure unit 15 and a feed path composing member 26, a cartridge accommodation chamber 90 for accommodating the inserted process cartridge 9 is formed. The cartridge accommodation chamber 90 communicates with the opening 7 (see FIGS. 1 and 7).

Sheet feed operation and image formation operation will be described in detail.

As shown in FIG. 1, the sheet feed unit 3 is provided with a pick-up roller 12, a separation roller 13A, a separation pad 13B and a pair of feed rollers 14. The sheet feed unit 3 separates a sheet S from a stack of sheets S accommodated in the sheet feed tray 5, and feeds the separated sheet S toward the image formation unit 4.

The sheet feed tray 5 is arranged below the process cartridge 9, and the sheet S picked up from the sheet feed tray 5 is fed, via a first feed path 20 and a second feed path 25, toward a position below the process cartridge 9. The first feed path 20 includes a U-shaped path, which has a U-shaped cross-sectional side view. The sheet S as fed is reversed as passing the U-shaped path, and is located below the process cartridge 9.

On an outside of the U-shaped path, a guide member 21 is disposed, and a lower face 21A of the guide 21 defines at least a part of the first feed path 20. An upper face 21A of the guide member 21 is disposed adjacent to an inner end of the manual feed opening 10 and guides the sheet S inserted through the manual feed opening 10 toward the image formation unit 4.

The second feed path 25 is defined between a sheet feed surface 48 which is formed by a lower face of the process cartridge 9 and the feed path composing member 26 opposing to the sheet feed surface 48. The second feed path 25 is connected from the first feed path 20, extends on the downstream side of the first feed path 20, and is connected to the nip between the photoconductive drum 31 and the transfer roller 33. At a position midway through the second feed path 25, a pair of register rollers 22 are disposed. Specifically, the pair of register rollers 22 includes a main body side register roller 23 disposed to the feed path composing member 26 and a cartridge side register roller 34 disposed to the lower face of the process cartridge 9.

The feed path composing member 26 is formed to bridge between the pair of frames 11 as shown in FIG. 7. As described later, since the process cartridge 9 is removable with respect to the main body, the second feed path 25 is formed when the process cartridge 9 is attached to the main body, and in such a state, the pair of register rollers 23 and 34 are arranged to contact with each other. When the process cartridge 9 is attached to the main body, the cartridge side register roller 34 is urged, at right-and-left side ends thereof, by springs 24 provided to the frames 11 such that the cartridge side register roller 34 is urged against the main body side register roller 23 at a predetermined pressure.

Between the guide member 21 and the sheet feed surface 49, an opening portion 28 exposed toward the opening 7 is formed. The opening portion 28 enables feeding of the sheet S inserted through the manual feed opening 10 toward the second feed path 25.

The sheet feed surface 48 is formed to have an upwardly concave shape so as to provide an admissible space 29 for allowing the sheet S, of which the leading end is to be registered by the nip of the pair of register rollers 22, to bend.

The image formation unit 4 is provided with the process cartridge 9, the exposure unit 15 and the fixing unit 16.

The exposure unit 15 is disposed at an upper portion inside the housing 2. The exposure unit 15 emits light (i.e., a laser beam indicated by arrowed broken line), which is modulated based on image data, toward the photoconductive drum 31.

The process cartridge 9 is configured to be inserted through the opening 7, between the exposure unit 15 and the feed path composing member 26, in a direction perpendicular to an axis of the photoconductive drum 31, and disposed at a predetermined position as positioned by a positioning member (not shown) provided to the frames 11. Inside the process cartridge 9, the photoconductive drum 31, the developing roller 36, a toner supplying roller 37 and a toner chamber 39 are arranged from the rear side to the front side thereof. On an upper rear side of the photoconductive drum 31, a scorotron type charger 32 is disposed, and below the photoconductive drum 31, the transfer roller 33 is disposed. Each of the photoconductive drum 31, and rollers 36, 37 and 33 extends in the right-and-left direction, and rotatable about an axis which also extends in the right-and-left direction.

When an image is formed on the sheet S, the toner in the toner chamber 39 is supplied to the developing roller 36 by the toner supplying roller 37. At this stage, the toner is frictionally charged between the toner supplying roller 36 and the developing roller 36 in a positive polarity.

The thickness of the toner supplied on the circumferential surface of the developing roller 36 is regulated by a regulating member as the developing roller 36 is rotated, and retained thereon as a thin layer of toner having a predetermined thickness.

The circumferential surface of the photoconductive drum 31 is uniformly and positively charged by the charger 32 as the photoconductive drum 31 rotates, and then exposed to a high-speed scanning laser beam emitted from the exposure unit 15. Then, an electrostatic latent image corresponding to an image to be formed on the sheet S is formed on the circumferential surface of the photoconductive drum 31.

The toner retained on the circumferential surface of the developing roller 36 is supplied to the electrostatic latent image formed on the circumferential surface of the photoconductive drum 31. As the toner is supplied, the electrostatic latent image is developed (i.e., visually recognizable image is formed). That is, on the circumferential surface of the photoconductive drum 31, a toner image according to reversal development is retained.

The toner image retained on the circumferential surface of the photoconductive drum 31 is transferred onto the sheet S when passing through the nip between the photoconductive drum 31 and the transfer roller 33.

The fixing unit 16 is arranged on a position opposite to the opening 7 with respect to the process cartridge 9 (i.e., arranged on the rear side). The fixing unit 16 is provided with a heat roller 17, and a pressure roller 18 facing the heat roller 17. The toner image transferred onto the sheet S in the process cartridge 9 is fixed by heat and pressure which are applied to the sheet S when passing through the nip between the heat roller 17 and the pressure roller 18.

The sheet S on which the toner image is fixed is fed toward the discharge roller 19, and discharged by the discharge roller 19 onto the discharge tray 6 arranged above the exposure unit 15.

Figure 3:
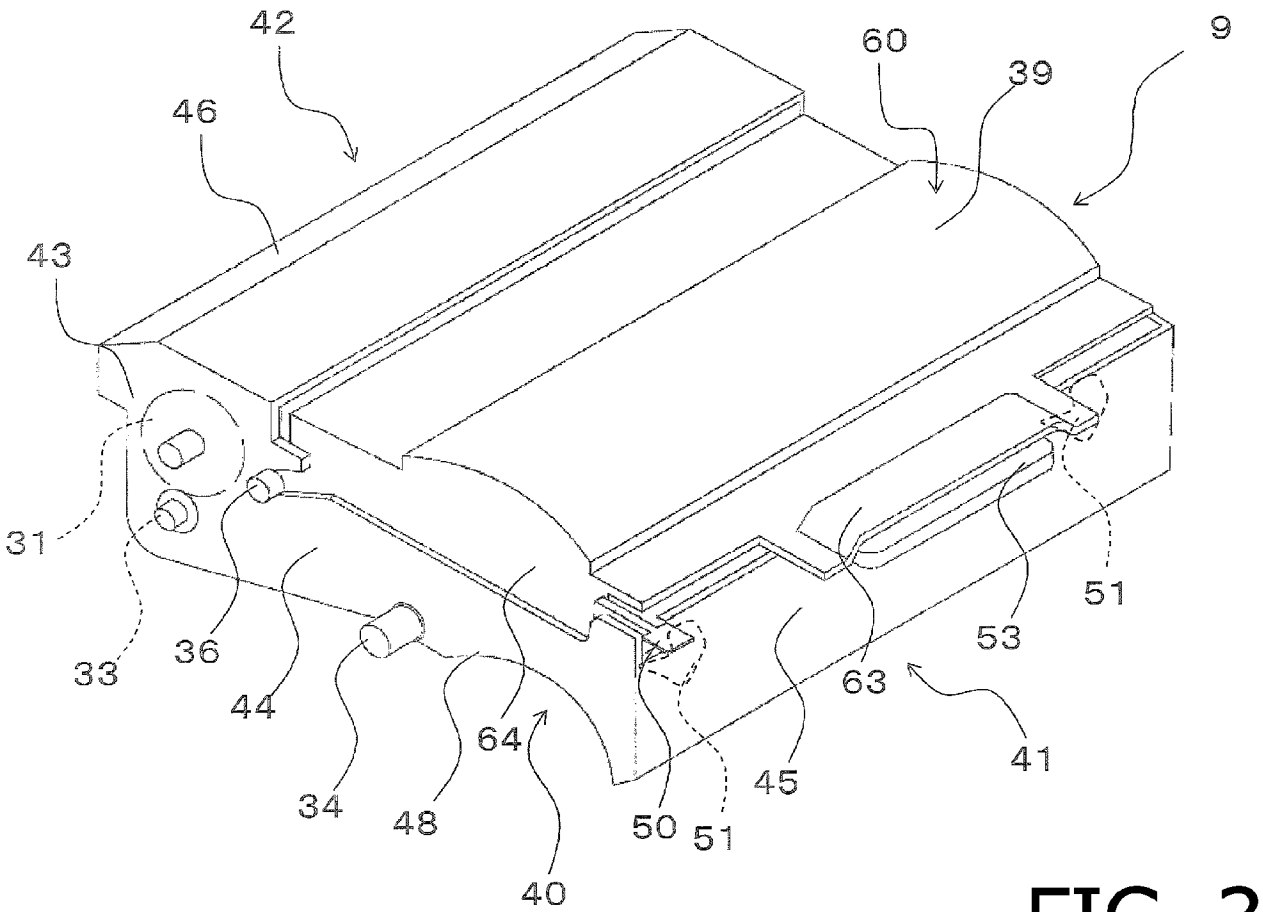
FIG. 3 is a perspective view of the process cartridge to be inserted in the image formation apparatus according to the embodiment of the invention.
Figure 4:
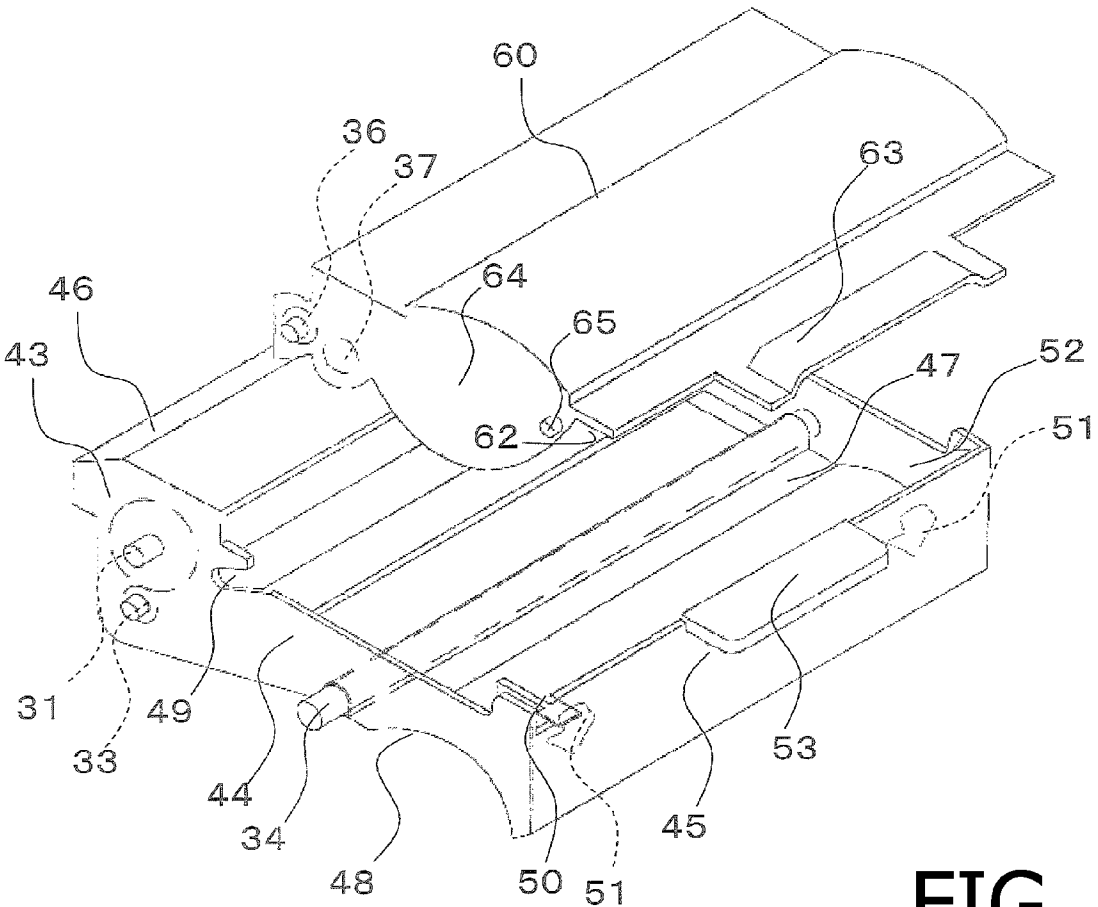
FIG. 4 is a perspective view of the process cartridge when a toner cartridge is attached to or detached from the process cartridge.

The process cartridge 9 is provided with a drum cartridge 40 and the toner cartridge 60 as shown in FIGS. 3 and 4. The photoconductive drum 31 and other rollers 36, 37 and 33 are distributed between the drum cartridge 40 and the toner cartridge 60, and supported therein.

The drum cartridge 40 has a frame 43 which has a generally box-like shape as shown in FIG. 3. The frame 43 has a bottom wall 47, a pair of side walls 44 which are raised up at the right-and-left side ends of the bottom wall 47 with a space therebetween, a front wall 45 which is disposed on the opening 7 side when the process cartridge 9 is attached to the main body, and a rear wall 46 which is disposed opposite to the front wall 45. The pair of side walls 44, the front wall 45 and the rear wall 46 are continuously connected to form a rectangular shape in plan view thereof.

The pair of side walls 44 rotatably support the photoconductive drum 31 and the transfer roller 33 at a rear portion 42 which is adjacent to the rear wall 46. An upper end of the rear wall 46 extends toward the front side so that the extended portion is located above the photoconductive drum 31 to cover the same.

The front portion 41 of the toner cartridge 40, which is located on the front side of the front end of the extended portion of the rear wall 46, is configured to form a toner cartridge accommodation section 52, which is a concave portion surround by the pair of side walls 44 and the front wall 45 and open to upward.

The toner cartridge 60 has a top wall, a bottom wall, a pair of side walls 64 and a front wall 62, which surround the toner chamber 39. The toner cartridge 60 does not have a rear wall and configured to have a box-like shape with its rear side being exposed to outside. The developing roller 36 and the toner supplying roller 37 are rotatably supported by the pair of side walls 64, and the developing roller 36 is exposed to outside through the rear side of the toner cartridge 60.

On the side walls 44, positioning slits 49 are formed by cutting out the side walls 44 toward the photoconductive drum 31. The toner cartridge 60 is mounted on the frame 43 such that the end portions, which are protruded from the toner cartridge 60, of the shaft of the developing roller 36 are inserted in the positioning slits 49, and urged toward the photoconductive drum 31 by an urging member 51. When mounted, the circumferential surface of the developing roller 36 is located close to the circumferential surface of the photoconductive drum 31. The toner cartridge 60 is held as a lock lever 50 engages with a protrusion 65 of the side wall 64 with the toner cartridge 60 is fitted in the cartridge accommodation section 52. When the lock lever 50 is released from the protrusion 65, the toner cartridge 60 can be removed from the cartridge accommodation section 52.

When the process cartridge 9 is mounted in the cartridge accommodation chamber 90, the toner chamber 39 is located on the opening 7 side with respect to the photoconductive drum 31 or the developing roller 36. Further, the pair of register rollers 22 are located on the rear side with respect to the opening 7 side end of the process cartridge 60.

It is noted that the process cartridge 9 side sheet feed surface 49 is defined by the lower surface of the bottom wall 47. The register roller 34 is rotatably supported by the bottom wall 47 with a part thereof is exposed from the bottom wall 47.

The drum cartridge 40 and the toner cartridge 60 have grip portions 53 and 63 extending toward the opening 7, respectively. The grip portions 53 and 63 are gripped by a user when the process cartridge 9 is attached to and/or detached from the main body.

According to the embodiments, the image formation apparatus can be packaged with the process cartridge 9 being mounted inside the image formation apparatus 1 so that materials for packaging can be reduced, and transportation efficiency is improved.

Figure 5:
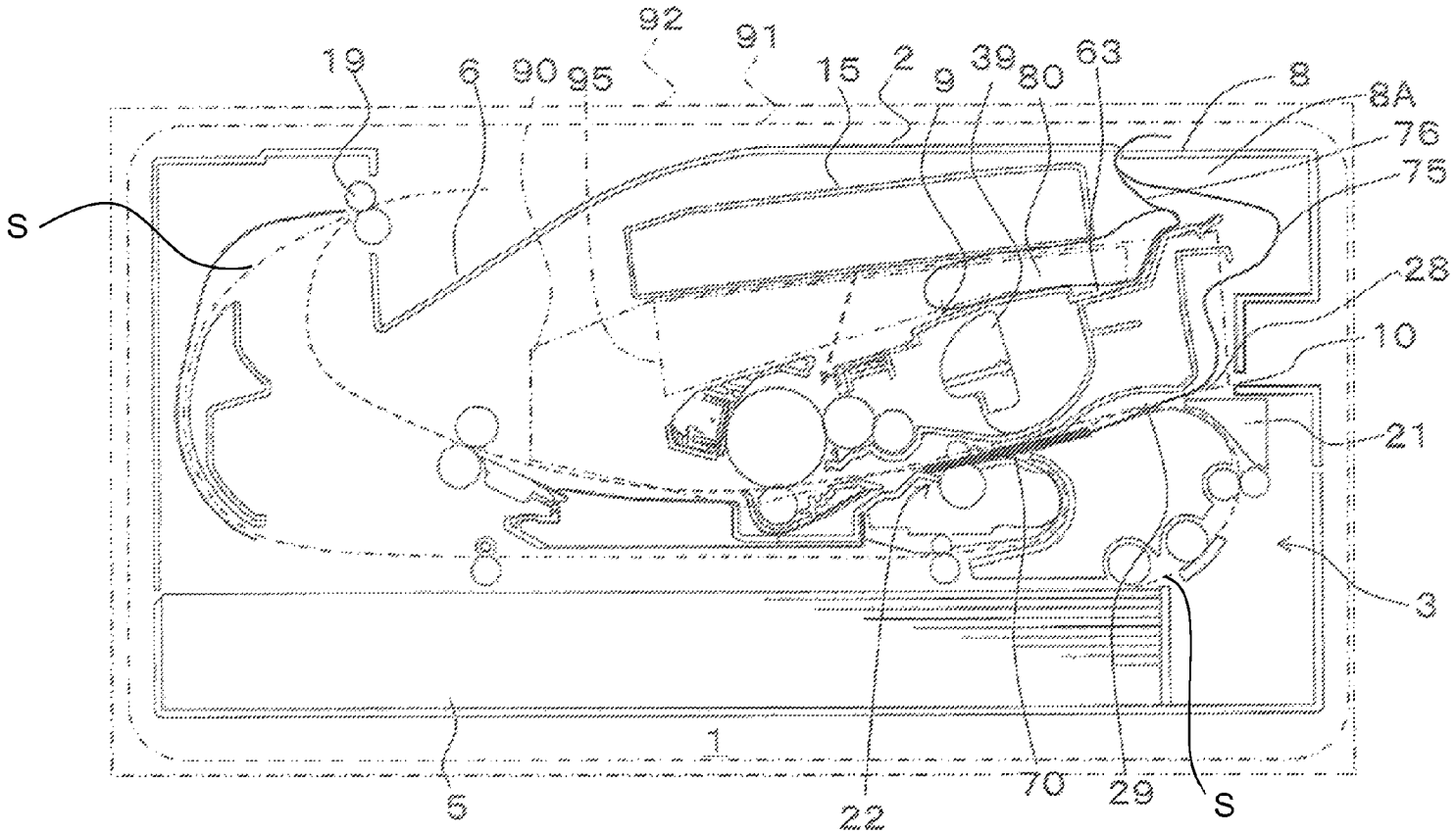
FIG. 5 is a cross-sectional side view of the image formation apparatus showing a packaging arrangement of the process cartridge inside a main body of the image formation apparatus according to a first embodiment of the invention.

When packaged, the process cartridge 9, a sheet member 70 and drying agent 80 are accommodated inside the image formation apparatus 1 as shown in FIG. 5.

The sheet member 70 is a resin sheet made of resin material, and used for holding the pair of register rollers 22 such that the register rollers 22 are spaced from each other or contacting pressure between the pair of register rollers 22 is maintained to be low. For example, if the register roller 34 is a rod-like roller having a uniform diameter, and the register roller 23 has shorter cylindrical pieces intermittently arranged in the axial direction as shown in FIG. 7, the sheet member 70 is inserted to be exist at positions between positions close to right-and-left ends of the register roller 34 and feed path composing member 26 or cut-out portions of the frames 11 connected to the feed path composing member 26. Specifically, the process cartridge 9 is mounted after the sheet member 70 is placed. Alternatively, the sheet member 70 may be arranged between the feed path composing member 26 and the sheet feed surface 48, avoiding the portion where the register rollers 34 and 23 contact. In one embodiment, the sheet member 70 may have a U-shaped structure, in plan view, including a pair of portions arranged at positions close to the right-and-left ends of the register roller 34 and a portion connecting the pair of portions on the opening 7 side.

By arranging the sheet member 70 as described above, the urging pressure which urges the register roller 23 toward the register roller 23 can be received by the frames 11 and/or the portions of the feed path composing member 36 close to the frames 11, deformation of the portions where the register rollers 23 and 34 contact, deformation of feed path composing member 26, or the like can be suppressed even if the image formation apparatus 1 with accommodating the processing cartridge 9 is placed in a high temperature environment for a relatively long time in packaged state.

The drying agent 80 is a bag-like member which is configured such that a number of silica gel grains are packed in a bag having high aeration property. The silica gel grains are moveable within the bag, and thus the drying agent 80 is deformable.

The drying agent 80 is arranged between the top face of the process cartridge 9 and the bottom face of the exposure unit 15, that is, at a clearance 95 between the process cartridge 9 and the exposure unit 15 inside the accommodation chamber 90. In one embodiment, the drying agent 80 is arranged to be sandwiched between the grip portion 63 and the toner chamber 39. The drying agent 80 is formed to be elongated in the right-and-left direction (i.e., in the axial direction of the photoconductive drum 31), and the length in the right-and-left direction and the length in the front-and-rear direction (i.e., a depth direction of the image formation apparatus 1) are greater than the length in a top-and-bottom direction, and the drying agent 80 has a flattened shape.

Since the drying agent 80 is arranged to be sandwiched between the process cartridge 9 and the exposure unit 15, although the image formation apparatus 1 is packaged with the process cartridge 9 being mounted therein, the toner can be well dried. In particular, since the drying agent 80 is disposed above the toner chamber 39, which is formed on the opening 7 side of the process cartridge 9. That is, the drying agent 80 is located at a position close to the toner when the image formation apparatus 1 is packaged. Therefore, the toner can be dried efficiently in the packaged state. Further, even if the image formation apparatus 1 is vibrated during transportation, shock caused by vibration is absorbed by the drying agent 80 which serves as a bumper as the silica gel grains move inside the bag. Therefore, by arranging the drying agent 80 as described above, damage of the process cartridge 9 or the main body can be suppressed. Furthermore, since the drying agent 80 is arranged close to the exposure unit 15, elimination of moisture of the exposure unit 15, which may be damaged by dew condensation, can be done.

The sheet member 70 and the drying agent 80 are connected by flexible belt members 75 and 76.

Figure 6:
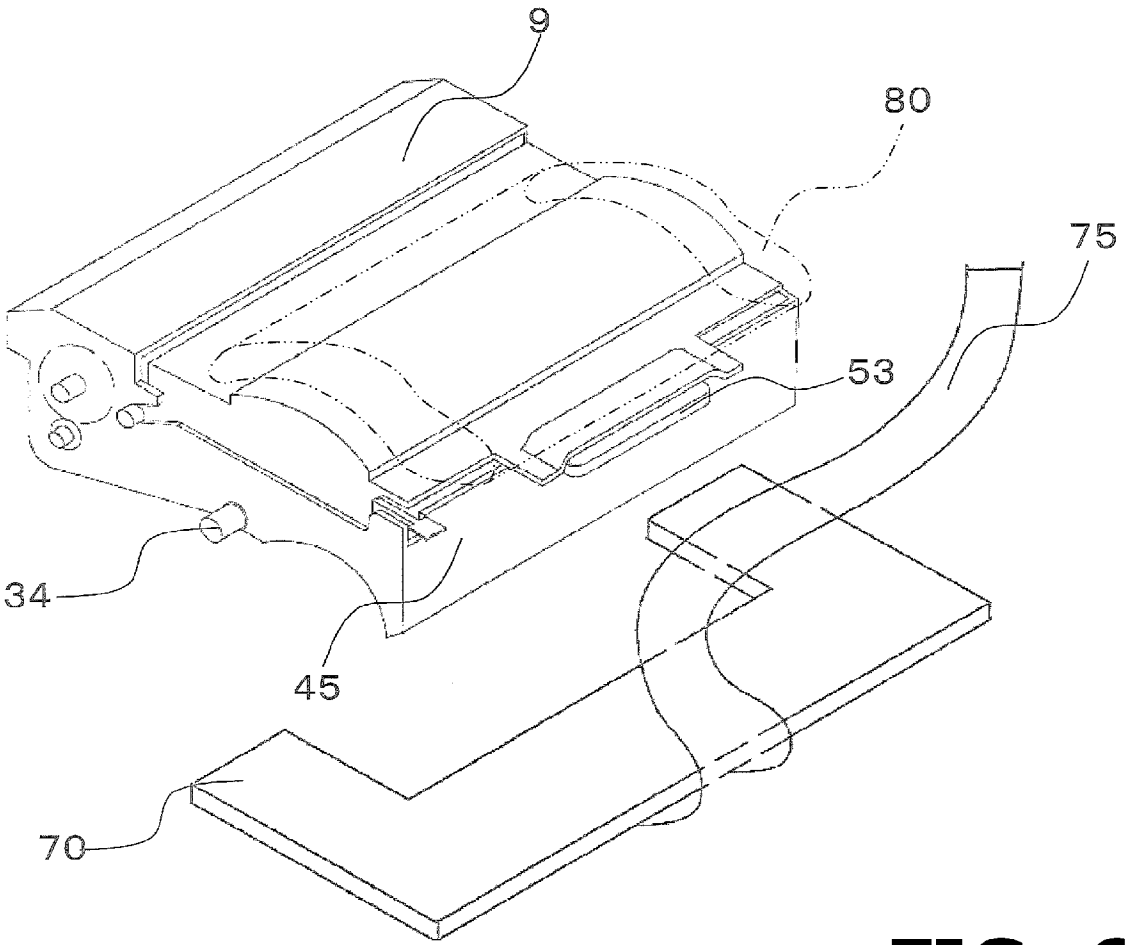
FIG. 6 shows a positional relationship of a sheet member, a drying agent and a belt member with respect to the process cartridge.

The belt member 75 is connected with the front end portion (i.e., the opening 7 side end portion) of the sheet member 70 as shown in FIGS. 5 and 6. The belt member 75 is extended, passing through the permissible space 29 and the opening portion 28, passing above the concave portion 8A and the process cartridge 9, toward outside the image formation apparatus 1 between the front cover 8 and the housing 2.

The belt member 76 is connected to the front end portion of the drying agent 80. The belt member 76 extends from the front end portion thereof and connected to the belt member 75 at portion thereof located above the process cartridge 9.

Since the belt member 75 is extended outside the image formation apparatus 1, user can easily recognize that the sheet member 70 and the drying agent 80 should be removed before using the image formation apparatus 1.

When packaged, the image formation apparatus 1 with accommodating the drying agent 80 and the sheet member 70 as well as the processing cartridge 9 is wrapped entirely, in a well-known manner, with a flexible wrapping bag 91 made of chroloethylene or the like, and then placed in a packing box such as a cardboard box.

It is noted that, according to the embodiment, the wrapping bag 91 may be of low aeration property so that drying effect of the drying agent 80 can be enhanced. It is also noted that such a low aeration property material also prevents moisture from entering inside the image formation apparatus, and the drying effect is also improved in this regard.

According to the embodiment described above, since the drying agent 80 has the flattened shape, it is possible that the drying agent 80 is arranged so as to extend along the toner chamber 39, which improves drying efficiency.

Figure 8:
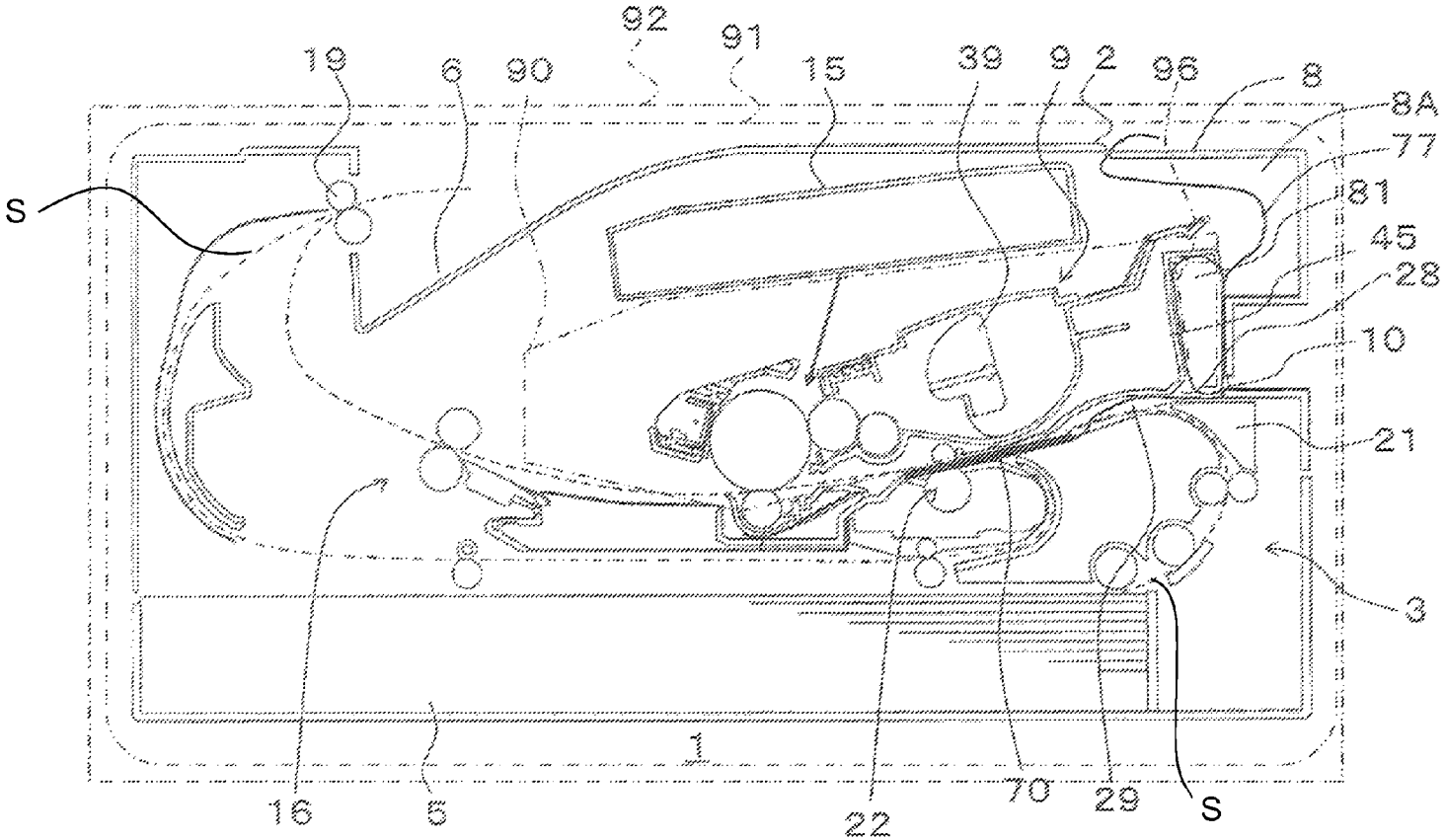
FIG. 8 is a cross-sectional side view of the image formation apparatus according to a second embodiment.

According to a second embodiment shown in FIG. 8, the drying agent 81 is placed between the front cover 8 and the process cartridge 9. In the second embodiment, the sheet member 70, the drying agent 81 and the belt member 77 are configured similarly to those of the first embodiment. Since the arrangement of the drying agent 81 is different from that in the second embodiment, a connecting position of the drying agent 81 with respect to the belt member 77 is different from the first embodiment, the configuration is substantially similar to that of the first embodiment. Therefore, components similar to those of the first embodiment will not be described in detail for brevity.

As shown in FIG. 8, the drying agent 81 is arranged between the upper face of the guide member 21 and the grip portion 53 of the drum cartridge 40, and between the inner face of the front cover 8 of the accommodation chamber 90 and the front wall 45 of the process cartridge 9. Further, the drying agent 81 is formed to have an elongated shape, along the front wall 45, in the right-and-left direction (i.e., in the axial direction of the photoconductive drum 31). In one embodiment, the length of the drying agent 81 in the right-and-left direction is substantially the same as the length of the process cartridge 9 in the right-and-left direction.

As the drying agent 81 is sandwiched and held between the process cartridge 9 and the front cover 8, even if the image formation apparatus 1 is shaken during transportation, the drying agent 81 absorbs the shock as the silica gel therein moves (i.e., the drying agent 81 serves as a cushioning medium. Therefore, the drying agent 81 suppresses the process cartridge 9 and the main body from being damaged.

It is noted that, in the above-described embodiments, the process cartridge 9 is configured to be movable to be detached from or attached to the main body along a direction substantially parallel with the sheet feed direction on the second feed path 25. Such a configuration can be modified such that one side end of the second feed path 25 is opened/closed with a cover, and the process cartridge 9 is configured to be detached from or attached to the main body by moving the same in the direction substantially perpendicular to the sheet feed direction.

Further, in the above-described embodiment, the process cartridge 9, the drum cartridge 40 and the toner cartridge 60 are separate components. Such a configuration can be modified such that the drum cartridge 40 and the toner cartridge 60 are formed to be an integrated member. Furthermore, the process cartridge 9 may be configured to accommodate only the toner, while the image formation apparatus 1 is configured such that the image formation apparatus includes the photoconductive drum 31. In such a case, the process cartridge 9 may be detachable from and/or attachable to the main body.

Furthermore, in the above-described embodiments, the drying agent 81 is configured such that grains of silica gel are inserted in a bag-like member. However, according to the invention, the drying agent 81 does not need to be limited to be such a configuration. For example, instead of the packed grains of silica gel, packed grains of silica-alumina gel, calcium-chloride processed members, or calcium hydroxide may be used as the drying agent 81. Alternatively or optionally, a thin plate-like (i.e., sheet-like) drying agent may also be used as the drying agent 81 which also serves as the cushioning member.

What is claimed is:

1. A packaging arrangement of an image formation apparatus and a process cartridge, comprising:

a main body of the image formation apparatus formed with an accommodation chamber configured to accommodate an exposure unit and a process cartridge containing toner used for image formation, the main body being formed with an opening through which the process cartridge is detachably attached to the main body, the image formation apparatus configured to be packaged with the process cartridge attached in the accommodation chamber;

an openable cover configured to openably cover the opening; and a drying agent detachably arranged in a clearance which is formed between the exposure unit and the process cartridge attached in the accommodation chamber such that, when the drying agent is arranged in the clearance, the drying agent contacts and is held between the exposure unit and the process cartridge, wherein the exposure unit is located above the process cartridge such that, when the drying agent is arranged in the clearance, the drying agent is above a top face of the process cartridge and below a bottom face of the exposure unit, wherein a part of the drying agent is exposed to an outside of the image formation apparatus through the opening of the clearance when the cover is in an opened state, and wherein the cover is configured to cover the exposure unit, the process cartridge, and the drying agent when the cover is in a closed state.

2. The packaging arrangement according to claim 1, wherein the drying agent is deformable with an external force applied to the drying agent, and wherein the drying agent is configured to be press-inserted in the clearance.

3. The packaging arrangement according to claim 1, wherein the process cartridge is configured to have:

a photoconductive member configured to form an image on a printing sheet and arranged at an end side, in a depth direction, which is opposite to the opening with respect to the accommodation chamber; and a toner accommodation section configured to accommodate toner to be supplied to the photoconductive member, wherein the drying agent is arranged at a position next to the toner accommodation section.

4. The packaging arrangement according to claim 3, wherein the clearance is substantially perpendicular to the depth direction of the accommodation chamber, the clearance extending in a width direction of the opening which is substantially parallel with the printing sheet configured to be fed toward the photoconductive member, and wherein the drying agent has a flattened shape which is defined such that lengths thereof in the depth direction and width direction are greater than a thickness thereof in the direction perpendicular to the depth and the width directions.

5. The packaging arrangement according to claim 3, wherein the image formation apparatus is a laser beam printer, wherein the exposure unit is configured to form an electrostatic latent image on the photoconductive member, and wherein the process cartridge is configured to supply toner to the electrostatic latent image which is transferred onto the printing sheet and fixed thereon.

6. The packaging arrangement according to claim 1, wherein the image formation apparatus containing the process cartridge and the drying agent is wrapped with a packaging material having a low aeration property.

7. A packaging arrangement of an image formation apparatus and a process cartridge, comprising:

a main body of the image formation apparatus formed with an accommodation chamber configured to accommodate a pair of register rollers and a process cartridge containing toner used for image formation, the main body being formed with an opening through which the process cartridge is detachably attached to the main body, the image formation apparatus configured to be packaged with the process cartridge attached in the accommodation chamber;

an openable cover configured to openably cover the opening;

a drying agent detachably arranged in a clearance which is formed between an inner face of the accommodation chamber and the process cartridge attached in the accommodation chamber; and a sheet member detachably arranged between the pair of register rollers and connected to the drying agent by a belt member, wherein a part of the drying agent is exposed to an outside of the image formation apparatus through the opening of the clearance when the cover is in an opened state, wherein the cover is configured to cover the pair or register rollers, the process cartridge, the drying agent, and the sheet member when the cover is in a closed state, and wherein at least a portion of the belt member is disposed outside of the main body of the image formation apparatus when the cover is in the closed state.

8. The packaging arrangement according to claim 7, wherein the drying agent is deformable with an external force applied to the drying agent, and wherein the drying agent is configured to be press-inserted in the clearance.

9. The packaging arrangement according to claim 7, wherein the process cartridge is configured to have:

a photoconductive member configured to form an image on a printing sheet and arranged at an end side, in a depth direction, which is opposite to the opening with respect to the accommodation chamber; and a toner accommodation section configured to accommodate toner to be supplied to the photoconductive member, wherein the drying agent is arranged at a position next to the toner accommodation section.

10. The packaging arrangement according to claim 9, wherein the clearance is substantially perpendicular to the depth direction of the accommodation chamber, the clearance extending in a width direction of the opening which is substantially parallel with the printing sheet configured to be fed toward the photoconductive member by the pair of register rollers, and wherein the drying agent has a flattened shape which is defined such that lengths thereof in the depth direction and width direction are greater than a thickness thereof in the direction perpendicular to the depth and the width directions.

11. The packaging arrangement according to claim 9, wherein the image formation apparatus is a laser beam printer having an exposure unit which is configured to form an electrostatic latent image on the photoconductive member, wherein the process cartridge is configured to supply toner to the electrostatic latent image which is transferred onto the printing sheet and fixed thereon, and wherein the clearance is formed between the exposure unit and the process cartridge.

12. The packaging arrangement according to claim 7, wherein the image formation apparatus containing the process cartridge and the drying agent is wrapped with a packaging material having a low aeration property.

* * * * *